United States Patent [19]

Saint-M'Leuz

[11] Patent Number: 4,611,952

[45] Date of Patent: Sep. 16, 1986

[54] METHOD OF FABRICATING THE LINES OF A TAUT-LINE PLATFORM AND OF PREPOSITIONING THEM PRIOR TO FINAL FIXING

[75] Inventor: René-Pierre Saint-M'Leux, Savenay, France

[73] Assignees: Institut Francais du Petrole; Bouygues Offshore; Compagnie Francaise d'Entreprises Metalliques CFEM; Alsthom Atlantique; Compagnie General pour les Developpements Operationnels des Richesses Sous-Marines CG Doris, all of France

[21] Appl. No.: 671,377

[22] Filed: Nov. 14, 1984

[30] Foreign Application Priority Data

Nov. 14, 1983 [FR] France ..... 83 18018

[51] Int. Cl.[4] ..... E02D 5/54

[52] U.S. Cl. ..... 405/224; 405/204; 405/195

[58] Field of Search ..... 405/224, 196, 203, 204, 405/206, 208, 207, 205; 114/264, 265; 166/338, 342

[56] References Cited

U.S. PATENT DOCUMENTS

| | | | |
|---|---|---|---|
| 3,919,957 | 11/1975 | Ray et al. | 405/224 |
| 4,226,555 | 10/1980 | Bourne, Jr. et al. | 405/224 |
| 4,320,993 | 3/1985 | Hunter | 405/224 |

FOREIGN PATENT DOCUMENTS

| | | | |
|---|---|---|---|
| 0097069 | 12/1983 | European Pat. Off. | 405/206 |
| 2044499 | 9/1969 | Fed. Rep. of Germany | 405/196 |

OTHER PUBLICATIONS

*Ocean Industry,* "New Developments to Watch", Oct. 1973.

*Primary Examiner*—Cornelius J. Husar
*Assistant Examiner*—Kristina I. Hall
*Attorney, Agent, or Firm*—Sughrue, Mion, Zinn, Macpeak, and Seas

[57] ABSTRACT

A method of fabricating the lines of a taut-line platform and of prepositioning them prior to final fixing by making use of a ballastable spacer frame associated with shuttles for guiding the lines as they are constructed including preparing a floating spacer frame that is submersible by ballasting, preparing a number of shuttles of a horizontal size approximate to the group of openings through the frame to receive the same with the shuttles having releasable upper and lower mechanisms for fixing to the frame in the floating platform respectively and suspended from a second winch, being guided against rotation and having horizontal plain thrusters. After exact orientation of a platform frame assembly relative to a base, the lowering of the frame shuttle assembly is effected by ballasting the platform under guidance and shuttle thruster operation with stowing of the frame on the base occurring under conditions in which the ends of lines are permitted to heave freely in the openings of the frame.

1 Claim, 17 Drawing Figures

METHOD OF FABRICATING THE LINES OF A TAUT-LINE PLATFORM AND OF PREPOSITIONING THEM PRIOR TO FINAL FIXING

The present invention relates to a method of fabricating the lines of a floating taut-line platform and of prepositioning them prior to subsequent final fixing.

BACKGROUND OF THE INVENTION

The advantages of taut-line platforms are already well-known, in particular in the technical fields of drilling and of production in deep seas.

It is recalled that such floating platforms are anchored to the sea bottom by means of lines which are anchored to foundations and which operate under tension.

FIG. 1 shows an example of such a platform comprising a deck 1 and columns 2 which are anchored by lines 3 that are fixed via connectors 4 to a base 5.

One of the technical problems posed by the use of taut-line platforms is the problem of connecting the ends of the lines to the sea bottom.

There are several known solutions to this problem:

When the anchor depth of the sea bottom is not more than 150 meters, it is possible, although difficult, to guide the ends of the lines to the connectors by observing the connectors by means of a television camera, and then displacing the platform assembly as a function of the observations. To this end the platform is provided with tug means. In addition a cone is provided for guiding the end of the line.

Preferred implementations of the present invention enable the connection of the lines that are about a thousand meters long. However, the method can also be applied to lines of any length.

The above-mentioned technique is not suitable when there is a long distance between the platform and the ends of the lines, because of the lack of rigidity of long lines.

It is known how to position long flexible risers connecting a ship to an undersea station. A dynamically positionable ship is used for the purpose. This technique relies on the inertia of the ship being relative low in comparison to that of a platform weighing nearly 100,000 tons, and is therefore not directly applicable to a platform. In addition, platforms are not equipped with their own propulsion means.

Even if one line could be connected by this method, the operation could not be repeated for the other lines.

The lack of rigidity in the lines means that the techniques for positioning rigid-legged platforms are inapplicable.

An aim of the present invention is to define a method of prepositioning the connectors situated on the ends of the lines of a taut-line platform at such a distance from the receptacles for the connectors on the base, that connection can be performed quickly without any risk of bad aiming.

SUMMARY OF THE INVENTION

The present invention provides a method of fabricating and prepositioning prior to final fixing the lines of a tautline floating platform, said platform comprising p groups of n lines each, the lines being fitted at their lower ends with respective connectors for co-operating with respective latching receptacles disposed on a base having np receptacles and fixedly placed on the sea bottom, the platform comprising p identical columns disposed around a regular polygon, each column comprising a line fabricating station, a gantry for handling the lines, a first winch, and a second winch, the platform comprising opposite to each column n openings through which the lines are lowered as they are fabricated, prepositioning being achieved when the connectors of all of the lines are placed at a distance of about one meter vertically above the corresponding receptacles, wherein the method comprises the following operations:

a floating spacer frame that is submersible by ballasting is prepared, said frame being constituted by a flat metal structure having p groups of vertical openings disposed in the same manner as the above-mentioned p columns, each group of openings comprising n channels disposed in the same manner as the lines of a group;

p shuttles are prepared, each constituted by a metal structure of horizontal size close to that of a group of openings through the frame, comprising releasable lower means for fixing to the frame and releasable means for fixing to the floating platform, means for suspension from said winch, guide means against rotation, and horizontal plane thrust means;

the shuttles are fixed to the frame, with each shuttle being disposed opposite a group of openings through the frame;

the frame is submerged and left suspended at a depth of about forty meters from floats;

the platform is brought vertically over the frame;

the frame is fixed to the cable of the first winch in each group;

the frame is raised until the shuttles come into contact with the platfrom, opposite the openings in the platfrom;

the shuttles are fixed to the platform;

the frame floats are cast off;

in each column a first line of each group is fabricated to its final length by fixing line components end-to-end, the line being supported and progressively submerged vertically from the gantry as it is fabricated, the line passing through the openings in the platform, in the shuttles, and in the frame, and each line including a resilient stop located a few meters from its bottom end;

the first winches are operated to lower the assembly constituted by the frame and the shuttles until the frame rests on the resilient stops of the lines, the end of each of the p lines then lodging in an opening through the frame, and the frame then being a few tens of meters from the base;

the second winches are operated to raise the shuttles until they make contact with the bottom of the platform;

the 2nd, 3rd, . . . and n-th lines of the p groups are successively fabricated and lowered at the rate at which they are fabricated by operating the gantry, the lines being guided by maneuvering the shuttles by means of the second winches, and each line of each group passing through an appropriate opening in the shuttle of its group;

when all the lines have been lowered by a last shuttle descent, the shuttles are fixed to the frame;

the platform-frame assembly is brought over the base by tug means, with the exact orientation of the frame being provided by operation of the shuttle thruster means;

the frame-shuttle assembly is lowered to within about one meter of the base by ballasting the platform, accurate guidance in horizontal directions being provided by the shuttle thruster means, and by center posts mounted on the base entering guide cones provided in the frame;

the frame is stowed on the base by operating the first winches, and the ends of the lines then heave freely in the openings of the frame at a distance of about one meter from the connectors.

BRIEF DESCRIPTION OF THE DRAWINGS

An implementation of the invention is described by way of example with reference to the accompanying drawings, in which.

MORE DETAILED DESCRIPTION

Figure 1:
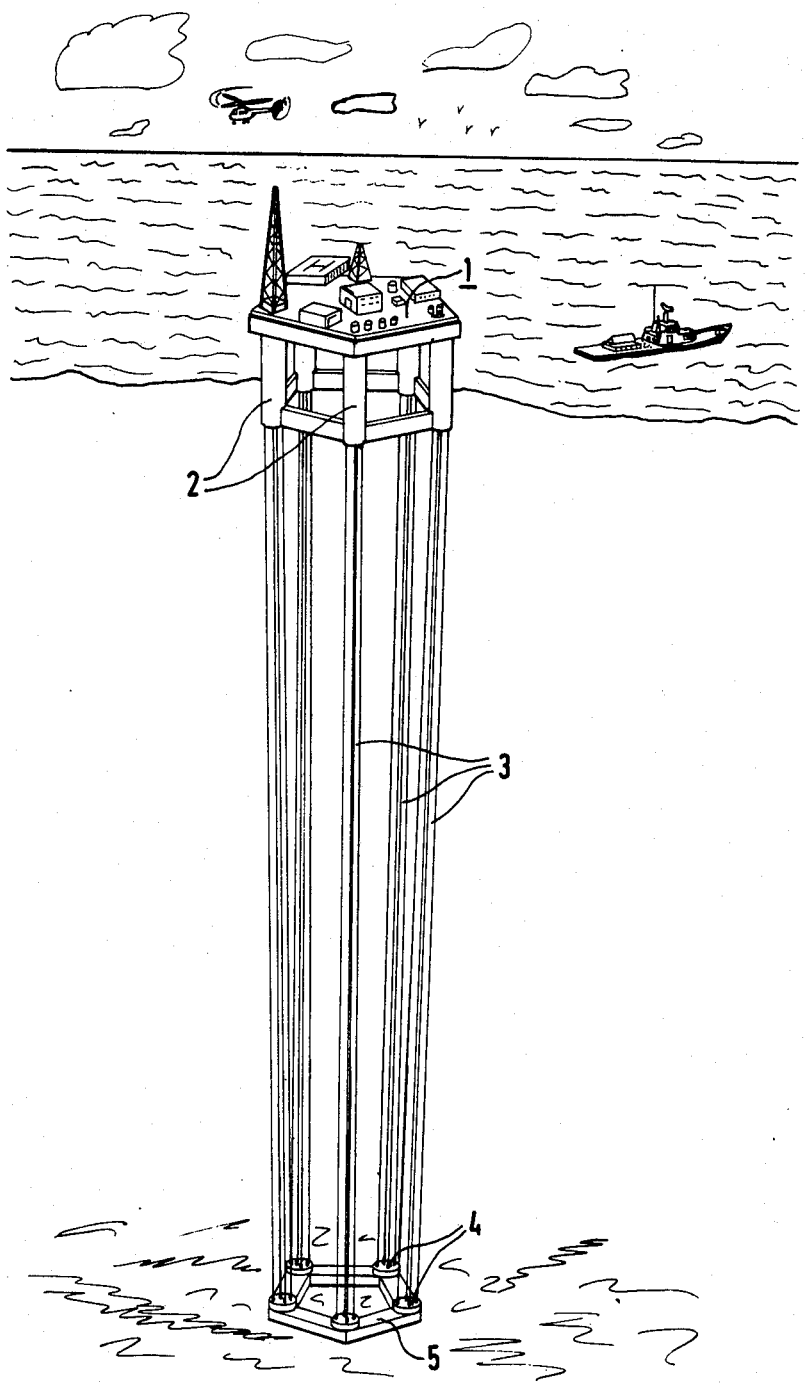
FIG.1 PRIOR ART
FIG. 1 is a diagrammatic perspective view of a taut-line platform.

FIG. 1 is described above.

Calculation shows that it is useful to have 5 groups of 4 lines each for a platform of 80,000 tons displacement. The following description is based on this example, but it must be understood that the invention is applicable to any number p of groups of lines and any number n of lines per group.

Figure 2:
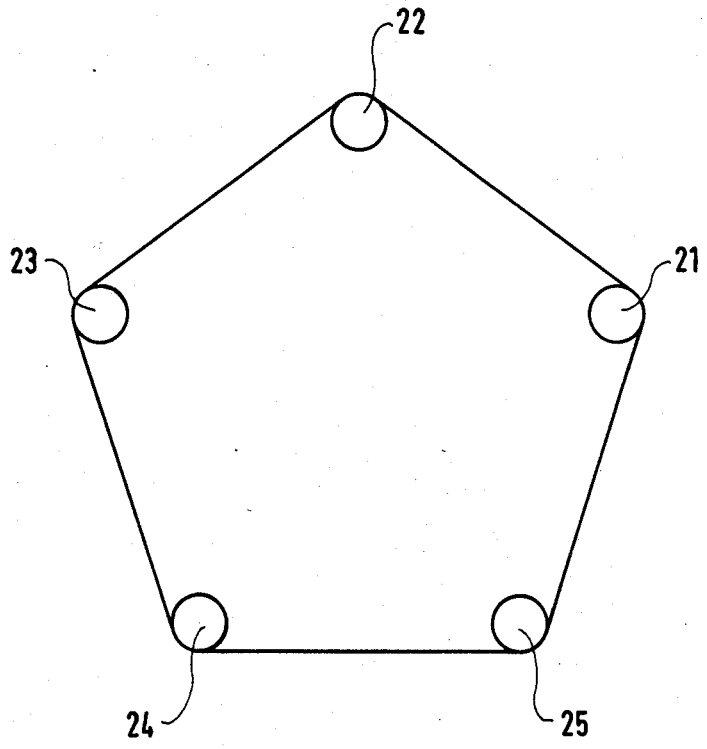
FIG. 2 is a diagram of a plan view of the platform.

Seen from above, (FIG. 2), the platform is in the form of a regular pentagon having five zones 21 to 25 at its apexes in which means for manufacturing, for handling, and for fixing the lines are grouped. These zones are advantageously columns which will be partially submerged.

Figure 3:
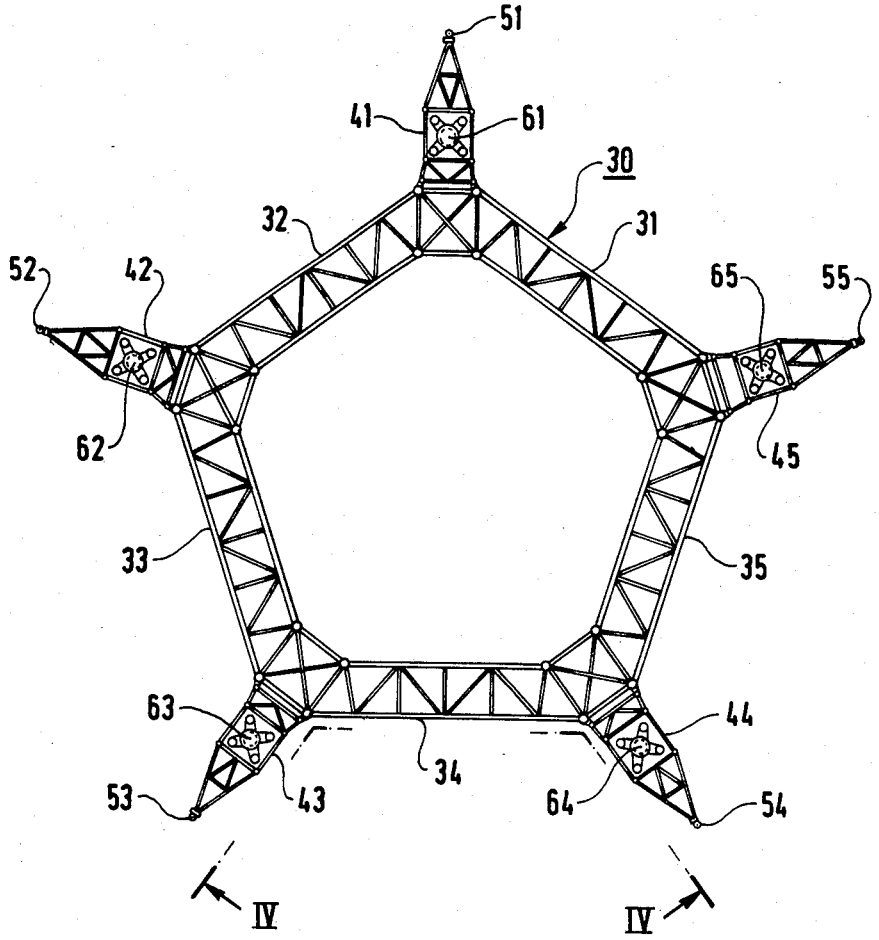
FIG. 3 is a diagrammatic plan view of a spacer frame used in implementing the method.
Figure 4:
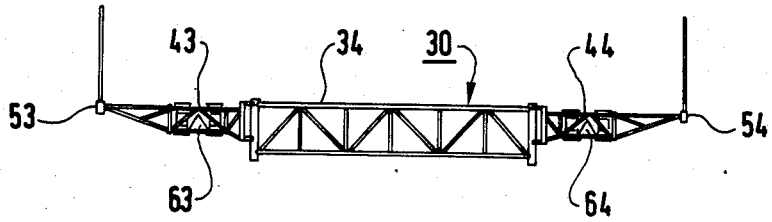
FIG. 4 is a diagrammatic view of the same spacer frame on a line IV—IV of FIG. 3.

To implement the method, a spacer frame 30 must be prepared (FIGS. 3, 4) in the form of a floating metal structure which is ballastable, flat, and comprising five arms 31 to 35 defining a pentagon identical to the pentagon delimiting the outer contour of the platform. Frame extensions 41 to 45 are placed at the apexes of the the pentagon to correspond with the columns 21 to 25 of the platform.

Each extension includes as many guide tubes as there are lines per group (4 in this case).

Brackets 51 to 55 are placed at the ends of the extensions for fixing the spacer frame to float cables.

Guide cones 61 to 65 are also placed at the centers of the extensions.

Their function is explained below.

Finally, the spacer frame has catches (not shown) enabling the shuttles to be releasably fixed thereto. The shuttles are now described.

Implementation of the method requires shuttles to be constructed, with one shuttle per group of lines.

Figure 5:
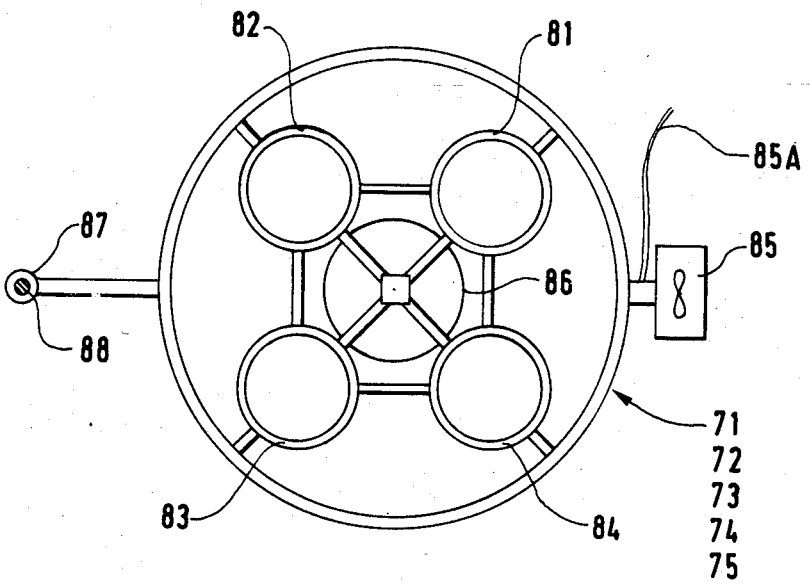
FIG. 5 is a diagrammatic plan view of a shuttle used in implementing the method.
Figure 6:
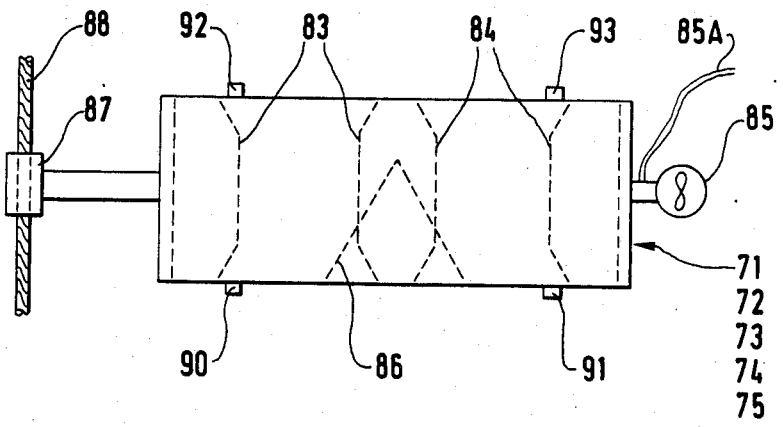
FIG. 6 is a diagrammatic elevation view of the same shuttle.
Figure 7:
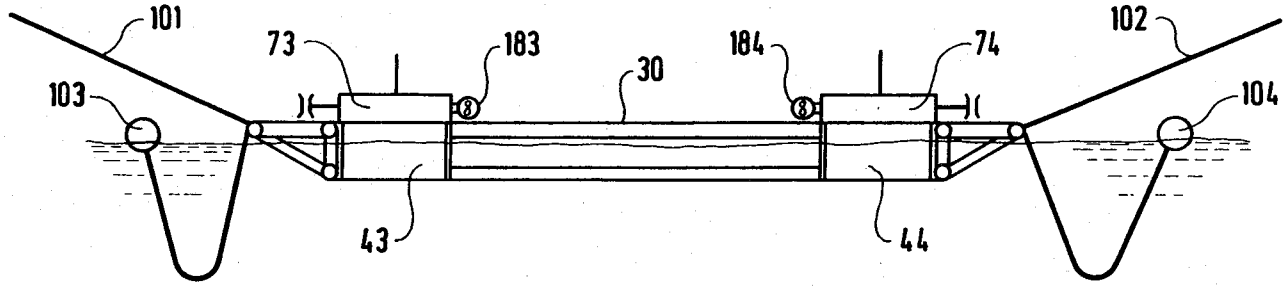
FIGS. 7 to 17 illustrate various stages of the prepositioning method in accordance with the invention.
Figure 8:
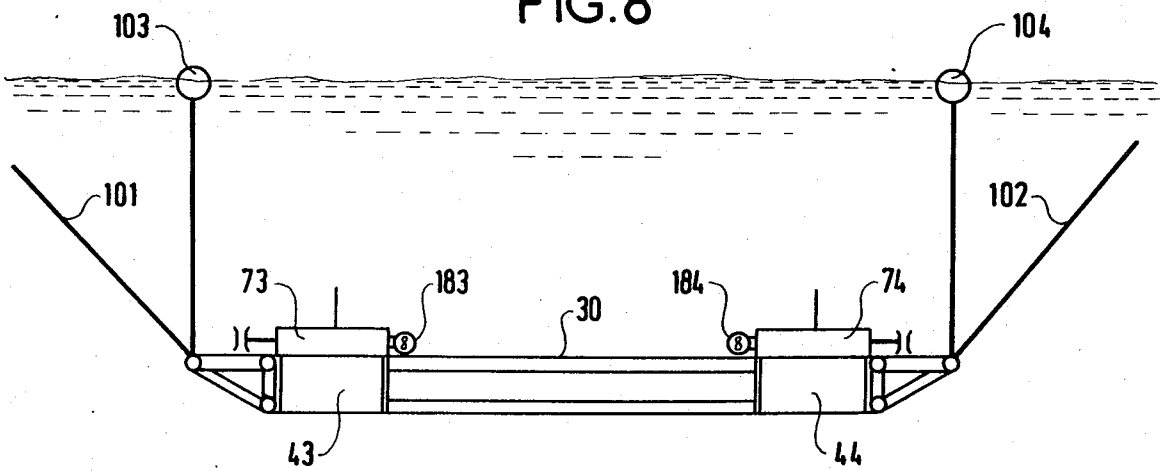
Figure 9:
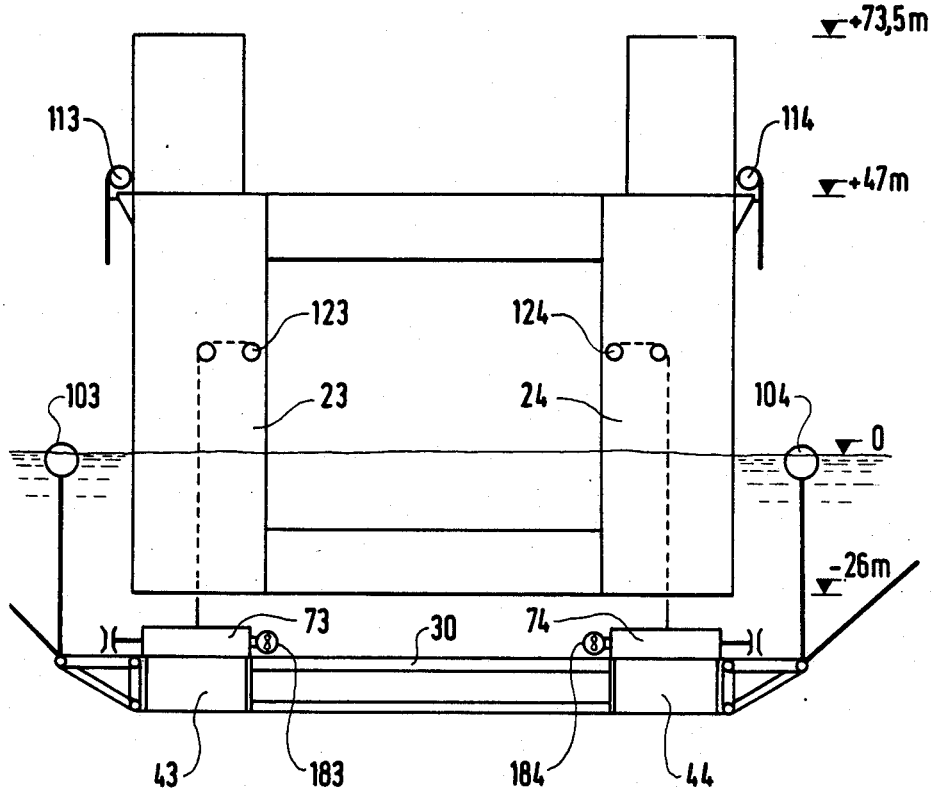
Figure 10:
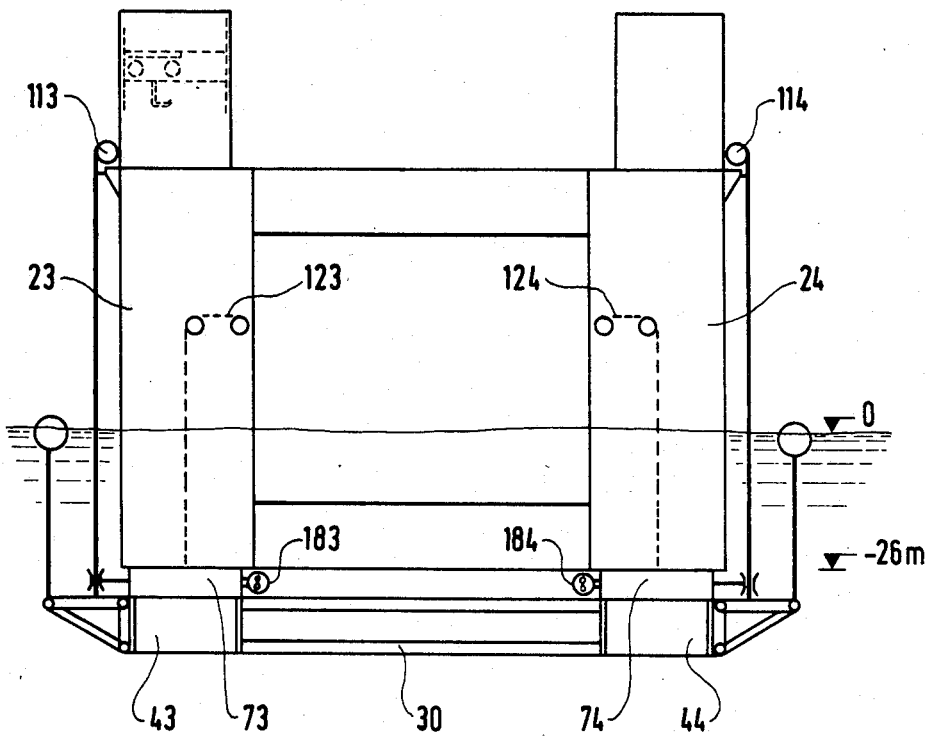

The shuttles are shown in FIGS. 5 and 6, and they are referenced 71 to 75.

The shuttles are a plane cylindrical structures of much the same diameter as the openings of the frame extensions 41 to 45.

Each shuttle has as many passages 81 to 84 passing therethrough as there are channels through the above-mentioned openings, and disposed in the same way as the channels. It includes a central guide cone 86.

Each shuttle is provide with propulsion means such as 85 constituted by electric or hydraulic motors driving a propeller, to enable the shuttles to move in a horizontal plane once they are fixed to the frame. The motors are powered from an umbilical cord 85A connected to a power generator placed on the platform.

Each shuttle includes guide means constituted by a tube 87 through which a frame-maneuvering cable 88 is free to slide.

Finally, each shuttle includes means for fixing to a cable 89, and releasable fastening means for engaging the frame (lower means 90, 91) or the platform (upper means 92, 93).

The method of prepositioning the lines is now described with reference to FIGS. 7 to 17.

FIG. 7

The frame 30 is floating on the sea. The shuttles are locked to the frame at the places provided therefor. In the figure, the shuttles 73 and 74 are shown fixed opposite the openings 43 and 44 respectively through the frame 30. Towing cables such as 101 and 102 and floats such as 103 and 104 are fixed to the frame.

FIG. 8

The frame is submerged to a depth of about 35 meters by being partially ballasted. It is held in this position by the floats.

FIG. 9

The platform is brought into place over the frame. Columns 23 and 24 can be seen in the figure. The maneuver is performed by tugs. Each column includes a powerful winch (e.g. 120 tons) 113, 114 and a less powerful winch (e.g. 20 tons) 123, 124. The shuttles are connected to the lighter winches 123, 124.

FIG. 10

The frame is connected to the more powerful winches 113, 114. It can be seen that the corresponding cables pass through the tubes (referenced 87 in FIGS. 5 and 6) of the shuttles.

These winches are used to raise the frame until the shuttles reach the underside of the platform where they are fastened.

The frame's floats and tow lines are then released.

FIG. 11

One line is constructed per column. For this purpose, each column has a line component assembly station. The lines may be rods or tubes which are screwed or welded together. Each column includes a corresponding fabrication station. The composition of the lines and their method of fabrication fall outside the scope of the present invention.

As line construction progresses, they are supported from gantries (such as 133 and 134) and they are lowered through the openings and channels through the shuttles and the frame.

Figure 11:
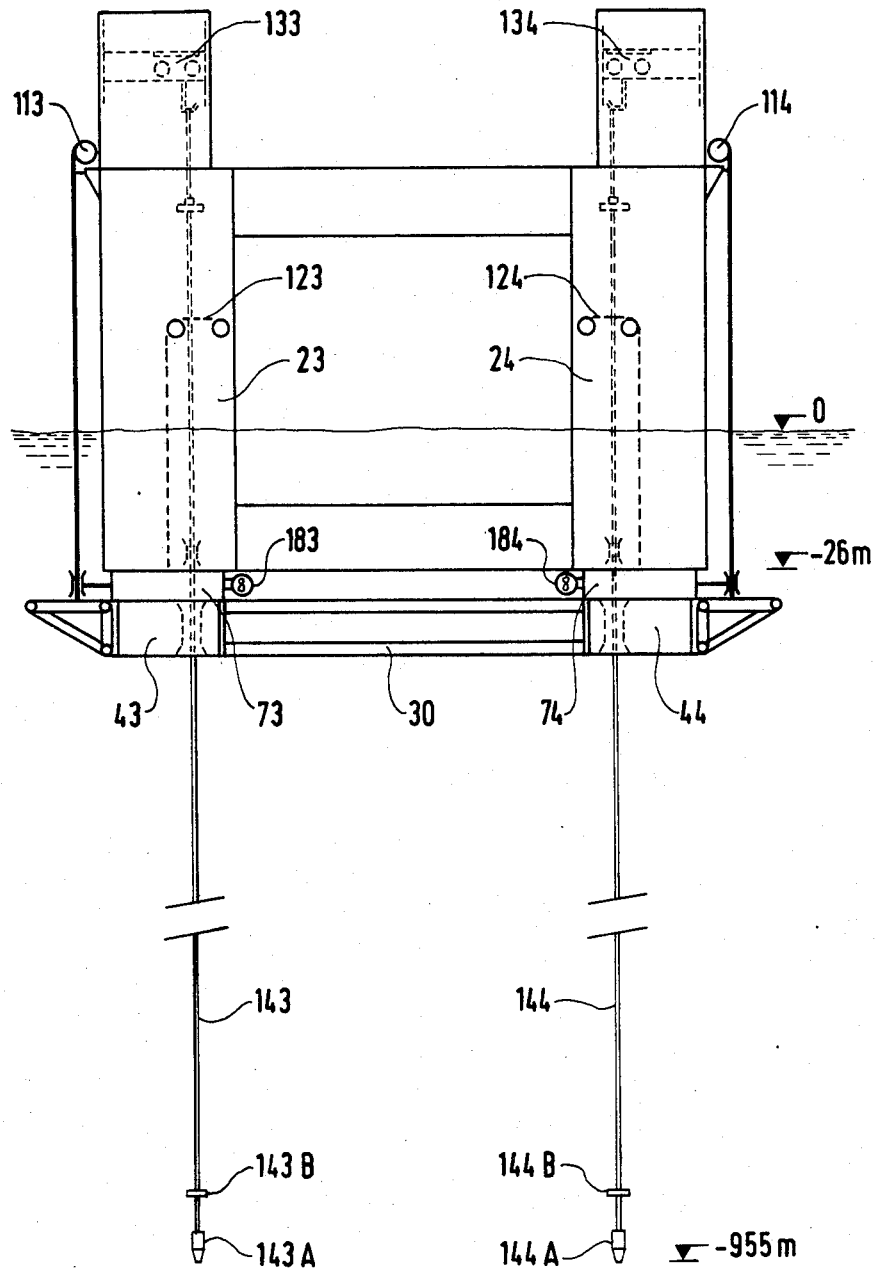
Figure 12:
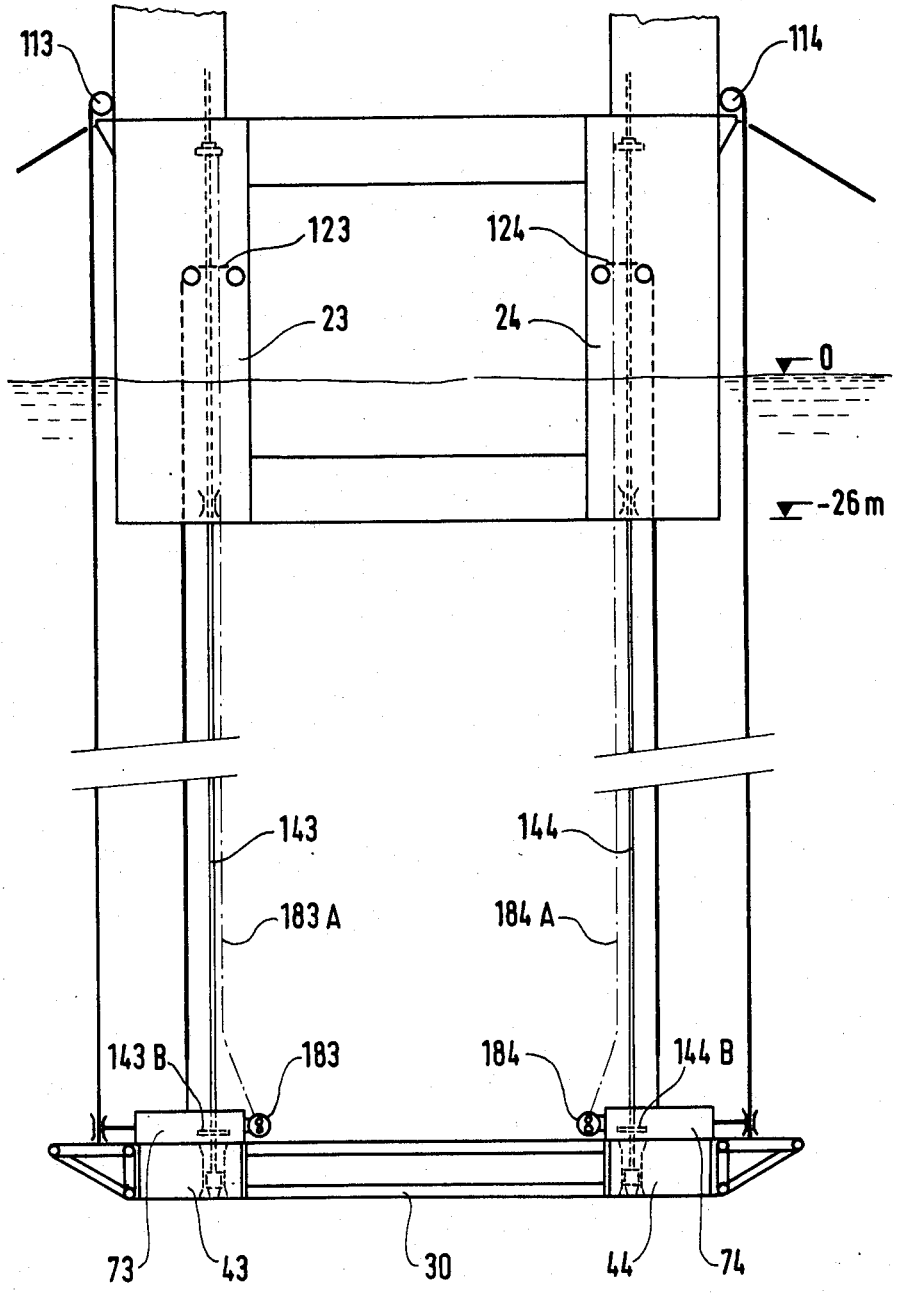
Figure 13:
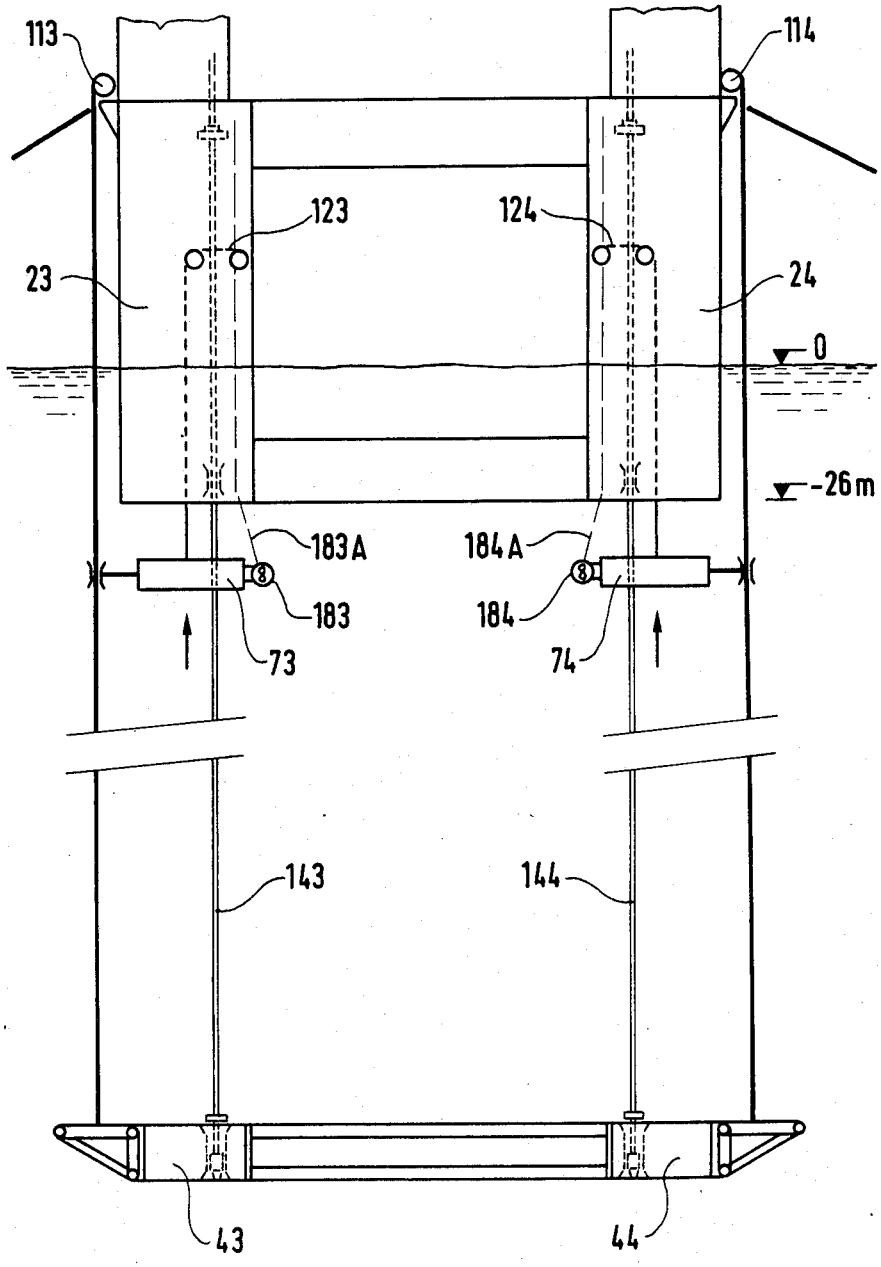
Figure 14:
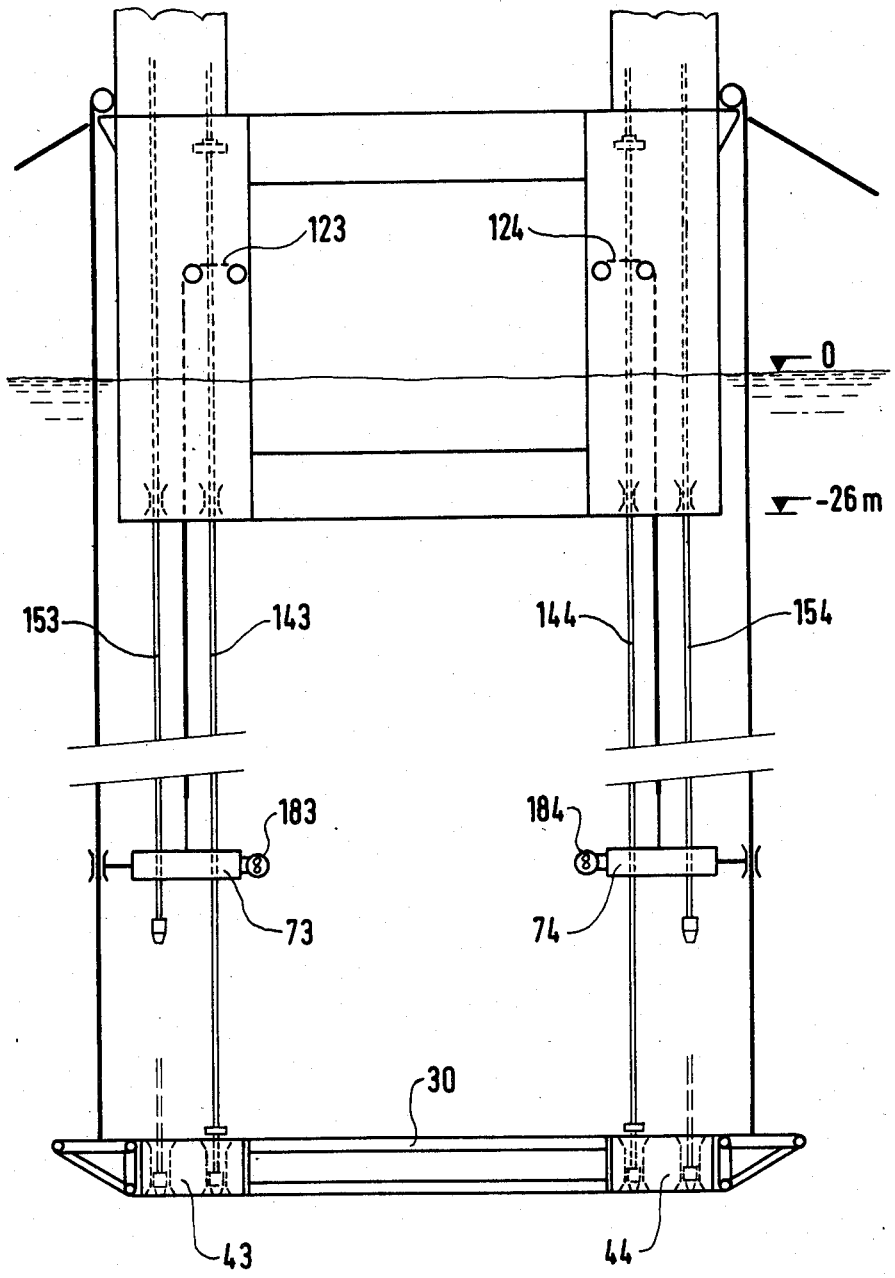
Figure 15:
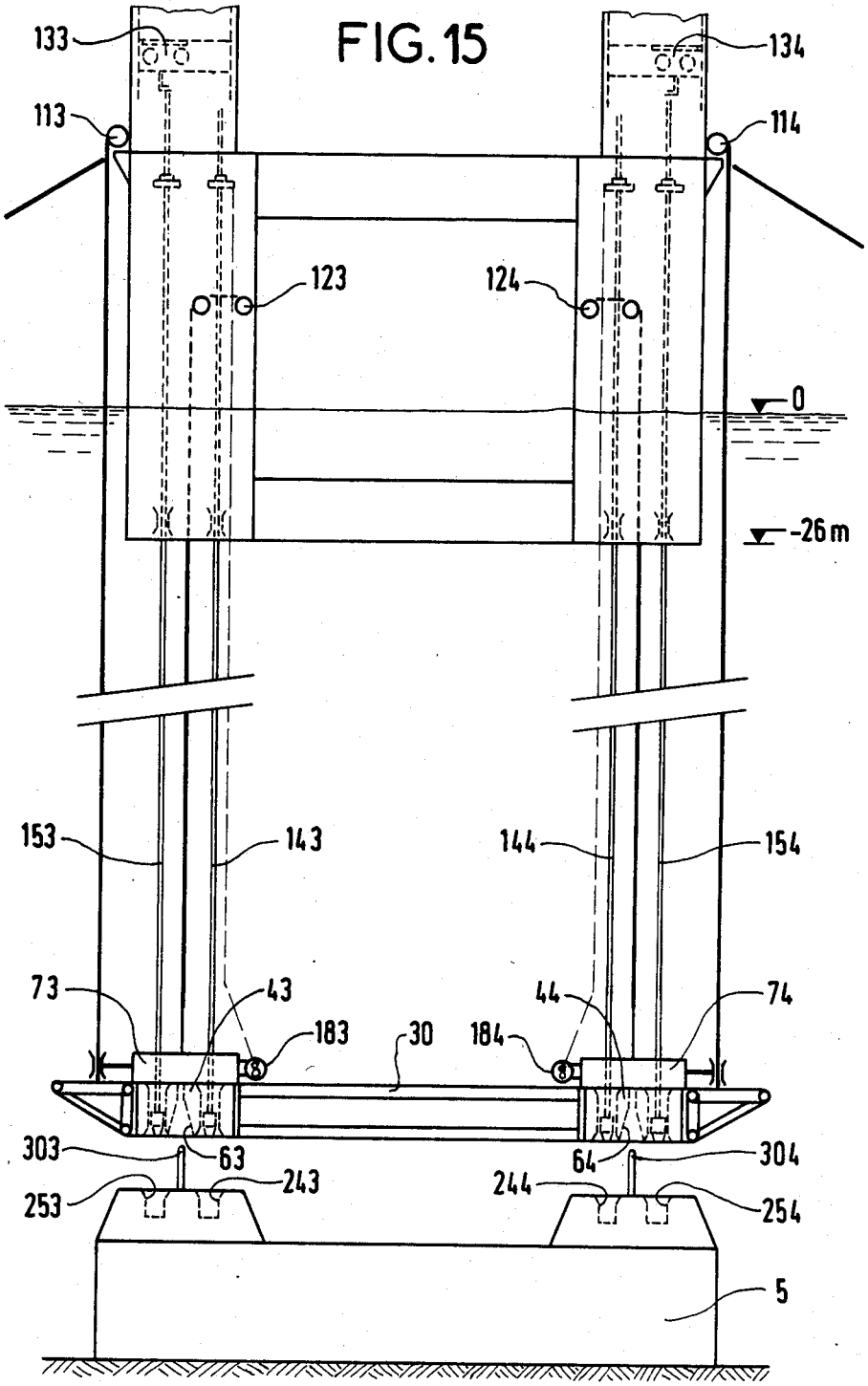
Figure 16:
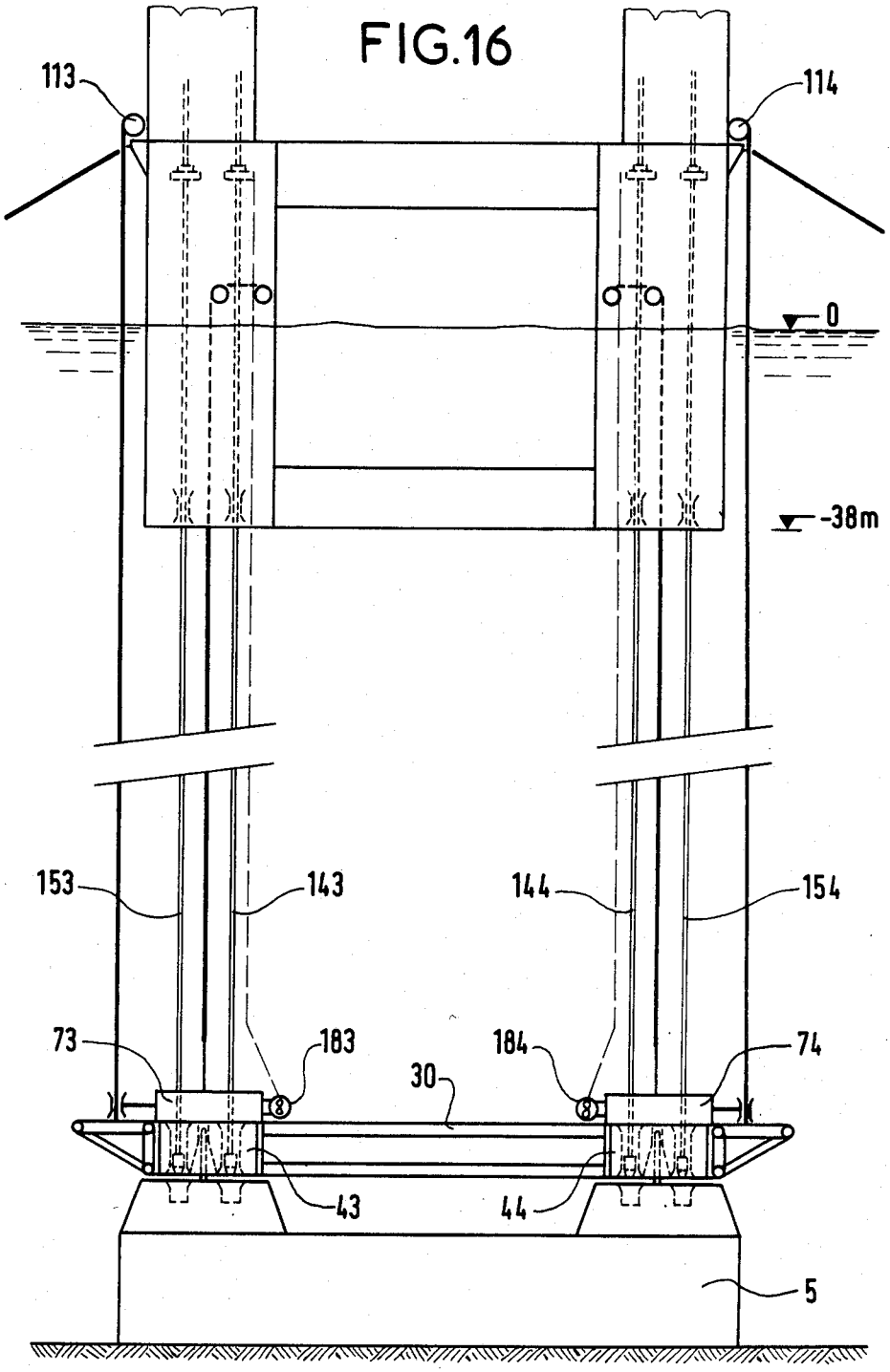
Figure 17:
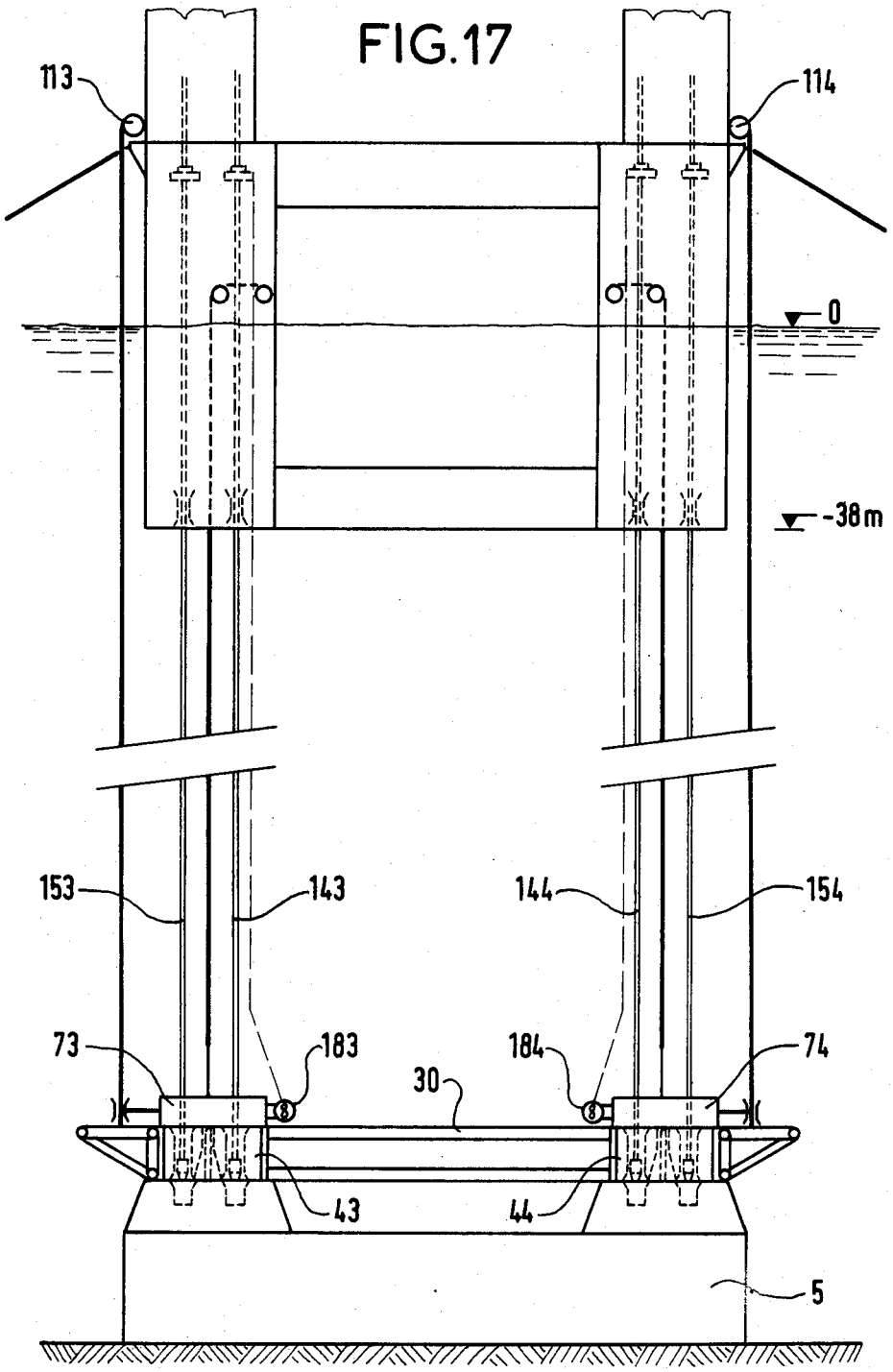

The ends of the lines 143 and 144 shown in FIG. 11 have connectors 143A, 144A for connection to the base, and stops 143B, 144B at a distance from the ends substantially equal to the thickness of the frame.

In the chosen example of 5 groups of lines, 5 identical lines are constructed simultaneously having the same length to within half a meter.

FIG. 12

The frame with the 5 shuttles connected thereto is fully ballasted and lowered by means of the more powerful winches 113, 114 to a depth of about 45 meters from the sea bottom, so as to come to rest against the stops. After the lengths of the 5 other lines are adjusted, the frame handling cables are held by the more powerful winches 113, 114. It is then known that the frame is horizontal.

FIG. 13

With the more powerful winches 113, 114, . . . still supporting the frame, the shuttles 73, 74, . . . are released from the frame, and they are raised to the platform by means of the less powerful winches. The electrical connections between the platform and the shuttles may then be removed.

FIG. 14

A second line is constructed from each column, i.e. 153, 154, . . . , and each line is engaged in a corresponding passage in its shuttle. Once the line has passed through to underneath the shuttle, the shuttle is lowered by its winch 123, 124, so as to guide the line which is thus prevented from striking or tangling the first line as already constructed. Once the end of the second line reaches the frame and engages the channel assigned to it, the shuttle is raised again. The third and fourth lines of each group are constructed in the same manner.

When beginning to construct the last line in a group, the electrical or hydraulic connections to the shuttle are re-established.

After the last line has been constructed, the shuttles are again locked to the frame.

FIG. 15

Once the lines are completed, the platform-frame assembly is brought into position over the base which may, for example, be in the form of a weight structure 5 resting on the sea bottom, having connector receptacles 243, 244, . . . 253, 254 disposed in 5 groups of 4, like the lines, together with centering posts 303, 304, . . .

The platform-frame assembly is lowered above the base to within a distance of about ten meters. Exact positioning is obtained by maneuvering the thrusters on the shuttles and with the help of video and/or acoustic means.

FIG. 16

The platform is ballasted to lower the frame to within about one meter of the base, and the centering posts engage in the cones in the frame.

FIG. 17

The frame 30 is stowed on the base 5 by maneuvering the more powerful winches 113, 114.

Prepositioning is thus terminated. The ends of the lines will heave freely in the channels through the frame.

After one line in each group has been fixed, the shuttles may be raised.

I claim:

1. A method of fabricating and prepositioning prior to final fixing the lines of a taut line floating platform, said platform comprising p groups of n lines each, the lines being fitted at their lower ends with respective connectors for engaging respective latching receptacles disposed on a base having np receptacles and fixedly placed on the sea bottom, the platform comprising p identical columns disposed around a regular polygon, each column comprising a line fabricating station, a gantry for handling the lines, a first winch, and a second winch, the platform comprising opposite to each column n openings through which the lines are lowered as they are fabricated, prepositioning being achieved when the connectors of all of the lines are placed at a distance of about one meter vertically above the corresponding receptacles, wherein the method comprises the following operations:

preparing a floating spacer frame that is submersible by ballasting, said frame being constituted by a flat metal structure having p groups of vertical openings disposed in the same manner as said p columns, each group of openings comprising n channels disposed in the same manner as the lines of a group;

preparing p shuttles, each constituted by a metal structure of horizontal size close to that of a group of and including in each line a resilient stop located a few meters from its bottom end;

operating the first winches to lower the assembly constituted by the frame and the shuttles until the frame rests on the resilient stops of the lines, the end of each of the p lines then lodging in an opening through the frame, and the frame then being a few tens of meters from the base;

operating the second winches to raise the shuttles until they make contact with the bottom of the platform;

successively fabricating and lowering the 2nd, 3rd, . . . and n-th lines of the p groups at the rate at which they are fabricated by operating the gantry, the lines being guided by maneuvering the shuttle by means of the second winches, and each line of each group passing through an appropriate opening in the shuttle of its group;

when all the lines have been lowered by a last shuttle descent, fixing the shuttles to the frame;

bringing the platform-frame assembly over the base by tug means, with the exact orientation of the frame being provided by operation of the shuttle thruster means;

lowering the frame-shuttle assembly to within about one meter of the base by ballasting the platform, providing accurate guidance in horizontal directions by openings through the frame, comprising releasable lower means for fixing to the frame and releasable upper means for fixing to the floating platform, means for suspension from said second winch, guide means against rotation, and horizontal plane thrust means;

fixing the shuttles to the frame, with each shuttle being disposed opposite a group of openings through the frame;

submerging the frame and leaving it suspended at a depth of about forty meters from floats;

bringing the platform vertically over the frame;

fixing the frame to the cable of the first winch in each group;

raising the frame until the shuttles come into contact with the platform, opposite the openings in the platform;

fixing the shuttles to the platform;

casting off the frame floats;

fabricating, in each column, a first line of each group to its final length by fixing line components end-to-end, supporting and progressively submerging the line vertically from the gantry as it is fabricated, passing the line through the openings in the platform, in the shuttles, and in the frame, and including in each line a resilient stop located a few meters from its bottom end;

operating the first winches to lower the assembly constituted by the frame and the shuttles until the frame rests on the resilient stops of the lines, the end of each of the p lines then lodging in an opening through the frame, and the frame then being a few tens of meters from the base;

operating the second winches to raise the shuttles until they make contact with the bottom of the platform;

successively fabricating and lowering the 2nd, 3rd, . . . and n-th lines of the p groups at the rate at which they are fabricated by operating the gantry, the lines being guided by maneuvering the shuttle by means of the second winches, and each line of each group passing through an appropriate opening in the shuttle of its group;

when all the lines have been lowered by a last shuttle descent, fixing the shuttles to the frame;

bringing the platform-frame assembly over the base by tug means, with the exact orientation of the frame being provided by operation of the shuttle thruster means;

lowering the frame-shuttle assembly to within about one meter of the base by ballasting the platform, providing accurate guidance in horizontal directions by the shuttle thruster means, and by center posts mounted on the base entering guide cones provided in the frame; and stowing the frame on the base by operating the first winches, whereby the ends of the lines may then heave freely in the openings of the frame at a distance of about one meter from the connectors.

* * * * *